US006210561B1

(12) United States Patent
Bradow et al.

(10) Patent No.: US 6,210,561 B1
(45) Date of Patent: Apr. 3, 2001

(54) STEAM CRACKING OF HYDROTREATED AND HYDROGENATED HYDROCARBON FEEDS

(75) Inventors: Carl W. Bradow, Pearland; Dane C. Grenoble, Nassau Bay; Richard M. Foley, Houston; Brendan D. Murray, Houston; Bruce H. C. Winquist, Houston; Stanley N. Milam, Houston, all of TX (US)

(73) Assignee: Exxon Chemical Patents Inc., Houston, TX (US)

( * ) Notice: Subject to any disclaimer, the term of this patent is extended or adjusted under 35 U.S.C. 154(b) by 0 days.

(21) Appl. No.: 08/854,017

(22) Filed: May 8, 1997

Related U.S. Application Data

(60) Provisional application No. 60/027,859, filed on Aug. 15, 1996, and provisional application No. 60/034,612, filed on Dec. 31, 1996.

(51) Int. Cl.[7] ..... C10G 69/02; C10G 69/06

(52) U.S. Cl. ..... 208/89; 208/143; 208/130; 208/58; 208/61; 585/251; 585/264

(58) Field of Search ..... 208/89, 143, 130, 208/58, 61; 585/251, 264

(56) References Cited

U.S. PATENT DOCUMENTS

| | | | | |
|---|---|---|---|---|
| 3,293,192 | | 12/1966 | Maher et al. | 252/430 |
| 3,449,070 | | 6/1969 | McDaniel et al. | 23/111 |
| 3,459,656 | * | 8/1969 | Rausch | 208/57 |
| 3,511,771 | * | 5/1970 | Hamner | 208/89 |
| 3,691,060 | * | 9/1972 | Inwood | 208/89 |
| 3,781,195 | * | 12/1973 | Davis et al. | 208/57 |
| 3,841,995 | * | 10/1974 | Bertolacini et al. | 208/89 |
| 3,898,299 | * | 8/1975 | Jones | 585/251 |
| 3,899,543 | * | 8/1975 | Cosyns et al. | 208/89 |
| 3,926,780 | * | 12/1975 | Ward | 208/111 |
| 4,021,330 | * | 5/1977 | Satchell, Jr. | 208/89 |
| 4,065,379 | * | 12/1977 | Soonawala et al. | 208/67 |
| 4,180,453 | * | 12/1979 | Franck et al. | 208/57 |
| 4,619,757 | | 10/1986 | Zimmermann | 208/57 |
| 4,801,373 | * | 1/1989 | Corman et al. | 208/210 |
| 4,960,505 | | 10/1990 | Minderhoud et al. | 208/143 |
| 5,114,562 | * | 5/1992 | Haun et al. | 208/89 |
| 5,391,291 | | 2/1995 | Winquist et al. | 208/143 |

* cited by examiner

*Primary Examiner*—Walter D. Griffin
(74) *Attorney, Agent, or Firm*—Bradley Keller

(57) ABSTRACT

An integrated process for converting a hydrocarbon feedstock having components boiling above about 100° C. into steam cracked products is described. The process first involves passing the feedstock to a hydrotreating zone to effect substantially complete decomposition of organic sulfur and/or nitrogen compounds. The product from the hydrotreating zone is passed to an aromatics saturation zone. The product is then passed to a steam cracking zone. Hydrogen and $C_1$–$C_4$ hydrocarbons, steam cracked naphtha, steam cracked gas oils and steam cracked tar are recovered. The amount of steam cracked tar produced is reduced by at least about 30 percent, and the amount of steam cracked tar produced is reduced by at least about 40 percent, basis the starting hydrocarbon feedstock which has not been subject to hydrotreating and aromatics saturation.

31 Claims, 2 Drawing Sheets

STEAM CRACKING OF HYDROTREATED AND HYDROGENATED HYDROCARBON FEEDS

This application claims the benefit of the filing of U.S. Provisional patent applications No. 60/027,859, filed Aug. 15, 1996 and 60/034,612, filed Dec. 31, 1996 relating to the hydrocarbon conversion process.

FIELD OF THE INVENTION

This invention relates to a process for upgrading hydrocarbon feedstocks for subsequent use in steam cracking. In particular, this invention describes a process for upgrading hydrocarbon feedstocks for use in steam cracking by the application of successive hydrotreating and hydrogenation of the unsaturated and/or aromatic species found therein, and the resultant yield increase of hydrogen, $C_1$–$C_4$ hydrocarbons and steam cracked naphtha, and the concomitant decrease in the yield of steam cracked gas oil and steam cracked tar, upon steam cracking of the hydrotreated and hydrogenated hydrocarbon feedstocks.

BACKGROUND OF THE INVENTION

Steam cracking is a process widely known in the petrochemical art. The primary intent of the process is the production of $C_1$–$C_4$ hydrocarbons, particularly ethylene, propylene, and butadiene, by thermal cracking of hydrocarbon feedstocks in the presence of steam at elevated temperatures. The steam cracking process in general has been well described in the publication entitled "Manufacturing Ethylene" by S. B. Zdonik et. al, Oil and Gas Journal Reprints 1966–1970. Typical liquid feedstocks for conventional steam crackers are straight run (virgin) and hydrotreated straight run (virgin) feedstocks ranging from light naphthas to vacuum gas oils. Gaseous feedstocks such as ethane, propane and butane are also commonly processed in the steam cracker.

The selection of a feedstock for processing in the steam cracker is a function of several criteria including: (i) availability of the feedstock, (ii) cost of the feedstock and (iii) the yield slate derived by steam cracking of that feedstock. Feedstock availability and cost are predominantly a function of global supply and demand issues. On the other hand, the yield slate derived by steam cracking of a given feedstock is a function of the chemical characteristics of that feedstock. In general, the yield of high value $C_1$–$C_4$ hydrocarbons, particularly ethylene, propylene and butadiene, is greatest when the steam cracker feedstocks are gaseous feedstocks such as ethane, propane and butane. The yield of high value steam cracked naphtha and low value steam cracked gas oil and steam cracked tar upon steam cracking of a straight run (virgin) or hydrotreated straight run (virgin) feedstocks increases as the boiling range of the feedstock increases. Thus, the steam cracking of liquid feedstocks such as naphthas, gas oils and vacuum gas oils generally results in a greater proportion of low value steam cracked products, i.e., steam cracked gas oil (SCGO) and steam cracked tar (SCT). In addition, steam cracking facilities where naphthas and gas oils are processed require additional capital infrastructure in order to process the large volume of liquid co-products resulting from steam cracking of those feedstocks.

What is more, the yield of the least desirable products of steam cracking, steam cracked gas oil and steam cracked tar, are generally even higher when low quality hydrogen deficient cracked feedstocks such as thermally cracked naphtha, thermally cracked gas oil, catalytically cracked naphtha, catalytically cracked gas oil, coker naphthas and coker gas oil are processed. The significantly increased yield of low value steam cracked gas oil and steam cracked tar products relative to production of high value $C_1$–$C_4$ hydrocarbon products obtained when processing the low quality hydrogen deficient cracked feedstocks is such that these feedstocks are rarely processed in steam crackers.

Catalytic hydrodesulfurization (sulfur removal), hydrodenitrification (nitrogen removal) and hydrogenation (olefins, diolefins and aromatics saturation) are well known in the petroleum refining art. Hydrodesulfurization, hydrodenitrification and partial hydrogenation have been applied to upgrading feedstocks for steam cracking as described by Zimmermann in U.S. Pat. No. 4,619,757. This two stage approach employed base metal, bi-metallic catalysts on both non-acidic (alumina) and acidic (zeolite) supports.

Minderhoud et. al., U.S. Pat. No. 4,960,505, described an approach for upgrading of kerosene and fuel oil feedstocks by first pre-treating the feedstock to effect hydrodesulfurization and hydrodenitrification to yield a liquid product with sulfur and nitrogen contaminants at levels of less than 1,000 and 50 ppm wt., respectively. Thereafter, the low impurity hydrocarbon stream was subjected to hydrogenation to yield a high cetane number fuel oil product.

Winquist et. al., U.S. Pat. No. 5,391,291, described an approach for upgrading of kerosene, fuel oil, and vacuum gas oil feedstocks by first pre-treating the feedstock to effect hydrodesulfurization and hydrodenitrification, and thereafter hydrogenation of the resultant liquid hydrocarbon fraction to yield a high cetane number fuel oil product.

It has been found that the present invention which comprises successive hydrotreating and hydrogenation steps followed by a steam cracking step results in significant yield improvements for hydrogen, $C_1$–$C_4$ hydrocarbons and steam cracked naphtha when applied to straight run (virgin) feedstocks; and results in high yields of hydrogen, $C_1$–$C_4$ hydrocarbons and steam cracked naphtha and reduced yields of steam cracked gas oil and steam cracked tar when applied to low quality, hydrogen deficient, cracked feedstocks such as thermally cracked naphtha, thermally cracked kerosene, thermally cracked gas oil, catalytically cracked naphtha, catalytically cracked kerosene, catalytically cracked gas oil, coker naphthas, coker kerosene, coker gas oil, steam cracked naphthas and steam cracked gas oils. The ability of this process to treat low quality hydrogen deficient cracked feedstocks, such as steam cracked gas oil, permits these heretofore undesirable feedstocks to be recycled to extinction through the combined feedstock upgrading and steam cracking system.

It has further been found that hydrogen, $C_1$–$C_4$ hydrocarbons and steam cracked naphtha can be produced in higher quantities in a process in which the effluent from at least one hydrotreating zone containing at least one hydrotreating catalyst is passed to an aromatics saturation zone containing an aromatics saturation catalyst, and the effluent from the aromatics saturation zone is then passed to a steam cracking zone. The effluents from the steam cracking zone are then passed to one or more fractionating zones in which the effluents are separated into a fraction comprising hydrogen and $C_1$–$C_4$ hydrocarbons, a steam cracked naphtha fraction, a steam cracked gas oil fraction and a steam cracked tar fraction. The process of the present invention results in improved yields of the high value steam cracked products, i.e., $C_1$–$C_4$ hydrocarbons, particularly ethylene, propylene, and butadiene, and steam cracked naphtha, particularly isoprene, cis-pentadiene, trans-pentadiene, cyclopentadiene, methylcyclopentadiene, and benzene, and reduced yields of steam cracked gas oil and steam cracked tar.

SUMMARY OF THE INVENTION

This invention provides an integrated process for converting a hydrocarbon feedstock having components boiling above 100° C. into steam cracked products comprising hydrogen, $C_1$–$C_4$ hydrocarbons, steam cracked naphtha (boiling from $C_5$ to 220° C.), steam cracked gas oil (boiling from 220° C. to 275° C.) and steam cracked tar (boiling above 275° C.).

The process of the present invention therefore comprises: (i) passing the hydrocarbon feedstock through at least one hydrotreating zone wherein said feedstock is contacted at an elevated temperature and pressure with a hydrogen source and at least one hydrotreating catalyst to effect substantially complete conversion of organic sulfur and/or nitrogen compounds contained therein to $H_2S$ and $NH_3$, respectively; (ii) passing the product from said hydrotreating zone to a product separation zone to remove gases and, if desired, light hydrocarbon fractions; (iii) passing the product from said product separation zone to an aromatics saturation zone wherein said product from said separation zone is contacted at elevated temperature and pressure with a hydrogen source and at least one aromatics saturation catalyst; (iv) passing the product from said aromatics saturation zone to a product separation zone to remove gases and, if desired, light hydrocarbon fractions and thereafter; (v) passing the product from said separation zone to a steam cracking zone and thereafter; (vi) passing the product from said steam cracking zone to one or more product separation zones to separate the product into a fraction comprising hydrogen and $C_1$–$C_4$ hydrocarbons, a steam cracked naphtha fraction, a steam cracked gas oil fraction and a steam cracked tar fraction, wherein the yields of ethylene and propylene and butadiene in the $H_2$ and $C_1$–$C_4$ hydrocarbons fraction are each increased by at least about 2.5 percent, relative to the yields obtained when either untreated or hydrotreated feedstock is subjected to said steam cracking and product separation, the yield of isoprene and cis-pentadiene and trans-pentadiene and cyclopentadiene and methylcyclopentadiene and benzene in the steam cracked naphtha fraction are each increased by at least about 15 percent, relative to when either untreated or hydrotreated feedstock is subjected to said steam cracking and product separation, the yield of steam cracked gas oil is reduced by at least about 30 percent, relative to when either untreated or hydrotreated feedstock is subjected to said steam cracking and product separation, and the yield of steam cracked tar is reduced by at least about 40 percent, relative to when either untreated or hydrotreated feedstock is subjected to said steam cracking and product separation.

DESCRIPTION OF THE PREFERRED EMBODIMENTS

Figure 1:
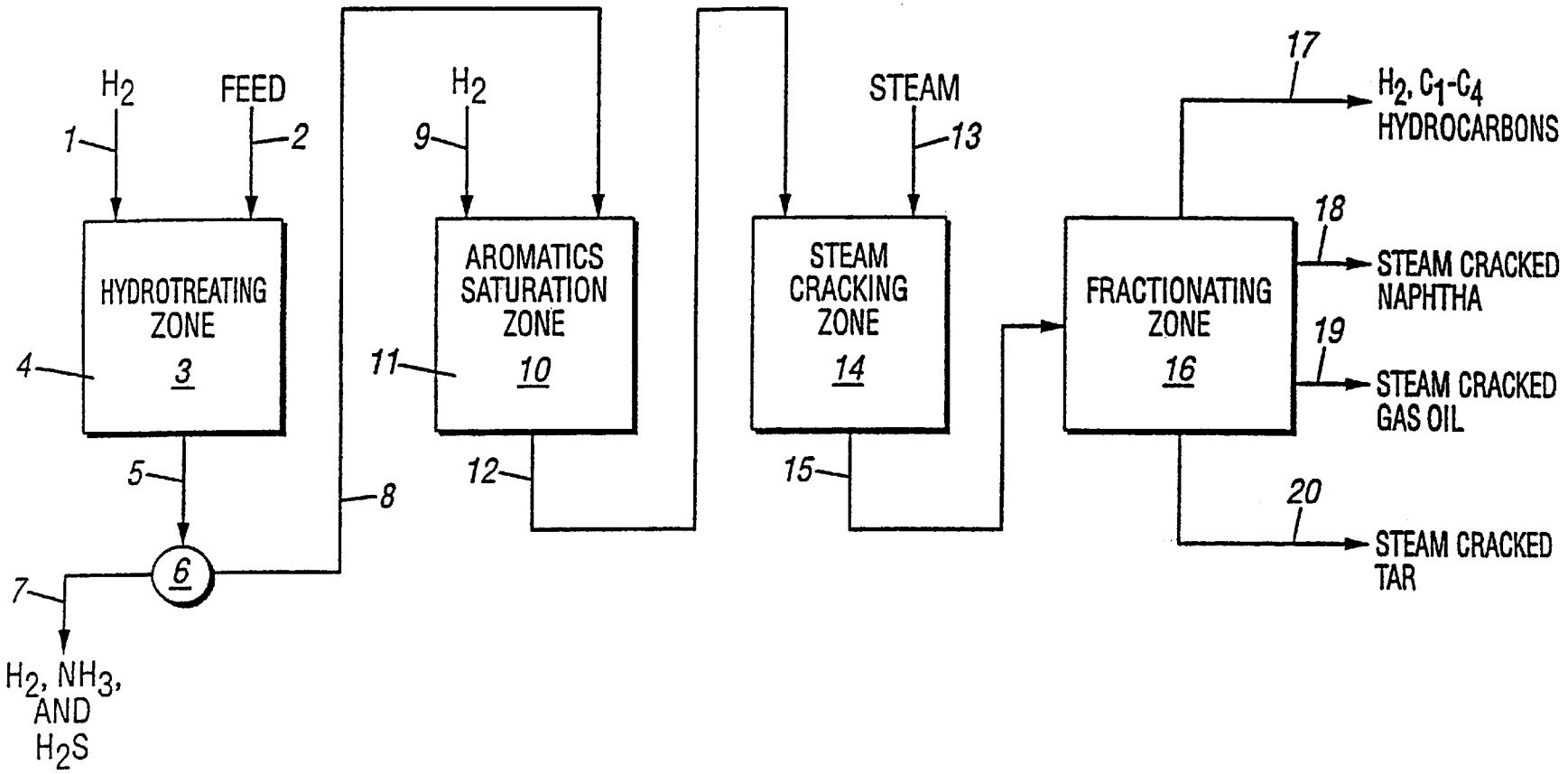
FIG. 1 illustrates one embodiment of the present process wherein a hydrogen containing gas stream is admixed with the hydrocarbon feedstock and passed to one hydrotreating zone employing at least one hydrotreating catalyst. The operating conditions of the hydrotreating zone are adjusted to achieve substantially completed desulfurization and denitrification of the hydrocarbon feedstock.

As used in this specification, the term "$C_1$–$C_4$ hydrocarbons" refers to methane, ethane, ethylene, acetylene, propane, propylene, propadiene, methylacetylene, butane, isobutane, isobutylene, butene-1, cis-butene-2, trans-butene-2, butadiene, and $C_4$-acetylenes. As used in this specification, the term "steam cracked naphtha" refers to products boiling between $C_5$ and 220° C., including isoprene, cis-pentadiene, trans-pentadiene, cyclopentadiene, methylcyclopentadiene, and benzene.

The hydrocarbon feedstock in the process of the present invention typically comprises a hydrocarbon fraction having a major proportion, i.e., greater than about 95 percent, of its components boiling above about 100° C., preferably above about 150° C. or higher. Suitable feedstocks of this type include straight run (virgin) naphtha, cracked naphthas (e.g. catalytically cracked, steam cracked, and coker naphthas and the like), straight run (virgin) kerosene, cracked kerosenes (e.g. catalytically cracked, steam cracked, and coker kerosenes and the like), straight run (virgin) gas oils (e.g. atmospheric and vacuum gas oil and the like), cracked gas oils (e.g. coker and catalytically cracked light and heavy gas oils, steam cracked gas oils and the like) visbreaker oil, deasphalted oil, thermal cracker cycle oil, synthetic gas oils and coal liquids. Normally the feedstock will have an extended boiling range, e.g., up to 650° C. or higher, but may be of more limited ranges with certain feedstocks. In general, the feedstocks will have a boiling range between about 150° C. and about 650° C.

In the hydrotreating zone, the hydrocarbon feedstock and a hydrogen source are contacted with at least one hydrotreating catalyst to effect substantially complete decomposition of organic sulfur and/or nitrogen compounds in the feedstock, i.e., organic sulfur levels below about 100 parts per million, preferably below about 50 parts per million, and more preferably below about 25 parts per million, and organic nitrogen levels below about 15 parts per million, preferably below about 5 parts per million, and more preferably below about 3 parts per million. The source of hydrogen will typically be hydrogen-containing mixtures of gases which normally contain about 70 volume percent to about 100 volume percent hydrogen. The catalyst will typically be one or more conventional hydrotreating catalysts having one or more Group VIB and/or Group VIII (Periodic Table of the Elements) metal compounds supported on an amorphous carrier such as alumina, silica-alumina, silica, zirconia or titania. Examples of such metals comprise nickel, cobalt, molybdenum and tungsten. The hydrotreating catalyst is preferably an oxide and/or sulfide of a Group VIII metal, preferably cobalt or nickel, mixed with an oxide and/or a sulfide of a Group VIB metal, preferably molybdenum or tungsten, supported on alumina or silica-alumina. The catalysts are preferably in sulfided form.

In a preferred embodiment, the hydrotreating zone contains at least two hydrotreating catalysts in a stacked bed or layered arrangement. When a stacked bed catalyst configuration is utilized, the first hydrotreating catalyst typically comprises one or more Group VIB and/or Group VIII metal compounds supported on an amorphous carrier such as alumina, silica-alumina, silica, zirconia or titania. Examples of such metals comprise nickel, cobalt, molybdenum and tungsten. The first hydrotreating catalyst is preferably an oxide and/or sulfide of a Group VIII metal, preferably cobalt or nickel, mixed with an oxide and/or a sulfide of a Group VIB metal, preferably molybdenum or tungsten, supported on alumina or silica-alumina. The second hydrotreating catalyst typically comprises one or more Group VIB and/or Group VIII metal components supported on an acidic porous support. From Group VIB, molybdenum, tungsten and mixtures thereof are preferred. From Group VIII, cobalt, nickel and mixtures thereof are preferred. Preferably, both Group VIB and Group VIII metals are present. In a particularly preferred embodiment, the hydrotreating component of the second hydrotreating catalyst is nickel and/or cobalt combined with tungsten and/or molybdenum with nickel/tungsten or nickel/molybdenum being particularly preferred. With respect to the second hydrotreating catalyst, the Group VIB and Group VIII metals are supported on an acidic carrier, such as, for example, silica-alumina, or a large pore molecular sieve, i.e. zeolites such as zeolite Y, particularly, ultrastable zeolite Y (zeolite USY), or other dealuminated zeolite Y. Mixtures of the porous amorphous inorganic oxide carriers and the molecular sieves can also be used. Typically, both the first and second hydrotreating catalysts in the stacked bed arrangement are sulfided prior to use.

The hydrotreating zone is typically operated at temperatures in the range of from about 200° C. to about 550° C., preferably from about 250° C. to about 500° C., and more preferably from about 275° C. to about 425° C. The pressure in the hydrotreating zone is generally in the range of from about 400 psig to about 3,000 psig, preferably from about 400 psig to about 1,500 psig. Liquid hourly space velocities (LHSV) will typically be in the range of from about 0.1 to about 10, preferably from about 0.5 to about 5 volumes of liquid hydrocarbon per hour per volume of catalyst, and hydrogen to oil ratios will be in the range of from about 500 to about 10,000 standard cubic feet of hydrogen per barrel of feed (SCF/BBL), preferably from about 1,000 to about 5,000 SCF/BBL, most preferably from about 2,000 to about 3,000 SCF/BBL. These conditions are adjusted to achieve substantially complete desulfurization and denitrification, i.e., organic sulfur levels below about 100 parts per million, preferably below about 50 parts per million, and more preferably below about 25 parts per million, and organic nitrogen levels below about 15 parts per million, preferably below about 5 parts per million, and more preferably below about 3 parts per million.

Alternatively, the hydrotreating step may be carried out utilizing two or more hydrotreating zones. For example, in one embodiment, the hydrotreating step can be carried out in the manner described below in which two zones, a first hydrotreating zone and a second hydrotreating zone, are used.

In the first hydrotreating zone, the hydrocarbon feedstock and a hydrogen source are contacted with a first hydrotreating catalyst. The source of hydrogen will typically be hydrogen-containing mixtures of gases which normally contain about 70 volume percent to about 100 volume percent hydrogen. The first hydrotreating catalyst will typically include one or more Group VIB and/or Group VIII metal compounds on an amorphous carrier such as alumina, silica-alumina, silica, zirconia or titania. Examples of such metals comprise nickel, cobalt, molybdenum and tungsten. The first hydrotreating catalyst is preferably an oxide and/or sulfide of a Group VIII metal, preferably cobalt or nickel, mixed with an oxide and/or a sulfide of a Group VIB metal, preferably molybdenum or tungsten, supported on alumina or silica-alumina. The catalysts are preferably in sulfided form.

The first hydrotreating zone is generally operated at temperatures in the range of from about 200° C. to about 550° C., preferably from about 250° C. to about 500° C., and more preferably from about 275° C. to about 425° C. The pressure in the first hydrotreating zone is generally in the range of from about 400 psig to about 3,000 psig, preferably from about 400 psig to about 1,500 psig. Liquid hourly space velocities (LHSV) will typically be in the range of from about 0.2 to about 2, preferably from about 0.5 to about 1 volumes of liquid hydrocarbon per hour per volume of catalyst, and hydrogen to oil ratios will be in the range of from about 500 to about 10,000 standard cubic feet of hydrogen per barrel of feed (SCF/BBL), preferably from about 1,000 to about 5,000 SCF/BBL, most preferably from about 2,000 to about 3,000 SCF/BBL. These conditions are adjusted to achieve the desired degree of desulfurization and denitrification. Typically, it is desirable in the first hydrotreating zone to reduce the organic sulfur level to below about 500 parts per million, preferably below about 200 parts per million, and the organic nitrogen level to below about 50 parts per million, preferably below about 25 parts per million.

The product from the first hydrotreating zone may then, optionally, be passed to a means whereby ammonia and hydrogen sulfide are removed from the hydrocarbon product by conventional means. The hydrocarbon product from the first hydrotreating zone is then sent to a second hydrotreating zone. Optionally, the hydrocarbon product may also be passed to a fractionating zone prior to being sent to the second hydrotreating zone if removal of light hydrocarbon fractions is desired.

In the second hydrotreating zone, the product from the first hydrotreating zone and a hydrogen source, typically hydrogen, about 70 volume percent to about 100 volume percent, in admixture with other gases, are contacted with at least one second hydrotreating catalyst. The operating conditions normally used in the second hydrotreating reaction zone include a temperature in the range of from about 200° C. to about 550° C., preferably from about 250° C. to about 500° C., and more preferably, from about 275° C. to about 425° C., a liquid hourly space velocity (LHSV) of about 0.1 to about 10 volumes of liquid hydrocarbon per hour per volume of catalyst, preferably an LHSV of about 0.5 to about 5, and a total pressure within the range of about 400 psig to about 3,000 psig, preferably from about 400 psig to about 1,500 psig. The hydrogen circulation rate is generally in the range of from about 500 to about 10,000 standard cubic feet per barrel (SCF/BBL), preferably from about 1,000 to 5,000 SCF/BBL, and more preferably from about 2,000 to 3,000 SCF/BBL. These conditions are adjusted to achieve substantially complete desulfurization and denitrification. Typically, it is desirable that the hydrotreated product obtained from the hydrotreating zone or zones have an organic sulfur level below about 100 parts per million, preferably below about 50 parts per million, and more preferably below about 25 parts per million, and an organic nitrogen level below about 15 parts per million, preferably below about 5 parts per million and more preferably below about 3 parts per million. It is understood that the severity of the operating conditions is decreased as the volume of the feedstock and/or the level of nitrogen and sulfur contaminants to the second hydrotreating zone is decreased. For example, if product gases, including $H_2S$ and $NH_3$ (ammonia), and, optionally, light hydrocarbon fractions are removed after the first hydrotreating zone, then the temperature in the second hydrotreating zone will be lower, or alternatively, the LHSV in the second hydrotreating zone will be higher.

The catalysts typically utilized in the second hydrotreating zone comprise an active metals component supported on an acidic porous support. The active metal component, "the hydrotreating component", of the second hydrotreating catalyst is selected from a Group VIB and/or a Group VIII metal component. From Group VIB, molybdenum, tungsten and mixtures thereof are preferred. From Group VIII, cobalt, nickel and mixtures thereof are preferred. Preferably, both Group VIB and Group VIII metals are present. In a particularly preferred embodiment, the hydrotreating component is nickel and/or cobalt combined with tungsten and/or molybdenum with nickel/tungsten or nickel/molybdenum being particularly preferred. The components are typically present in the sulfide form.

The Group VIB and Group VIII metals are supported on an acidic carrier. Two main classes of carriers known in the art are typically utilized: (a) silica-alumina, and (b) the large pore molecular sieves, i.e. zeolites such as Zeolite Y, Mordenite, Zeolite Beta and the like. Mixtures of the porous amorphous inorganic oxide carriers and the molecular sieves are also used. The term "silica-alumina" refers to non-zeolitic aluminosilicates.

The most preferred support comprises a zeolite Y, preferably a dealuminated zeolite Y such as an ultrastable zeolite Y (zeolite USY). The ultrastable zeolites used herein are well known to those skilled in the art. They are also exemplified in U.S. Pat. Nos. 3,293,192 and 3,449,070, the teachings of which are incorporated herein by reference. They are generally prepared from sodium zeolite Y by dealumination.

The zeolite is composited with a binder selected from alumina, silica, silica-alumina and mixtures thereof. Preferably the binder is alumina, preferably a gamma alumina binder or a precursor thereto, such as an alumina hydrogel, aluminum trihydroxide, aluminum oxyhydroxide or pseudoboehmite.

The Group VIB/Group VIII second hydrotreating catalysts are preferably sulfided prior to use in the second hydrotreating zone. Typically, the catalysts are sulfided by heating the catalysts to elevated temperatures (e.g., 200–400° C.) in the presence of hydrogen and sulfur or a sulfur-containing material.

The product from the final hydrotreating zone is then necessarily passed to a means whereby ammonia and hydrogen sulfide are removed from the liquid hydrocarbon product by conventional means. The liquid hydrocarbon product from the final hydrotreating zone is then sent to an aromatics saturation zone. Prior to being sent to the aromatics saturation zone, however, the liquid hydrocarbon product may be passed to a fractionating zone for removal of product gases, and light hydrocarbon fractions.

In the aromatics saturation zone, the product from the final hydrotreating zone and a hydrogen source, typically hydrogen, about 70 volume percent to about 100 volume percent, in admixture with other gases, are contacted with at least one aromatics saturation catalyst. The operating conditions of the aromatics saturation zone generally include a temperature between about 200° C. and about 370° C., preferably between about 250° C. and about 350° C., and most preferably between about 275° C. and about 350° C., and a pressure in the range of from about 400 psig to about 3,000 psig, preferably in the range of from about 400 psig to about 1,500 psig, more preferably in the range of from about 400 psig to about 1,000 psig and most preferably in the range of from about 400 psig to about 600 psig. Space velocities between about 0.1 and about 10 volumes of liquid hydrocarbon per hour per volume of catalyst can be applied, preferably between 0.5 and 5 and most preferably between 1 and 3. Hydrogen/feedstock ratios between about 2,000 and about 15,000 SCF/BBL, preferably between about 3,000 and about 10,000 SCF/BBL, and most preferably between about 4,000 and about 8,000 SCF/BBL, can be suitably applied. It should be noted that the temperature to be applied is dependent on the nature of the feedstock to be saturated and the volume of feedstock supplied to the aromatics saturation zone. Typically, a temperature will be chosen which allows substantial hydrogenation of the hydrogenatable components in the feedstock, i.e., at least about 70% of the total amount of components to be hydrogenated. It is preferable to carry out aromatics saturation under conditions which allow at least 80% conversion by hydrogenation of the hydrogenatable components, with greater than 90% conversion by hydrogenation being particularly preferred. By a proper choice of temperature and pressure for the aromatics saturation zone, more than 95% of the hydrogenatable components can be hydrogenated without causing substantial simultaneous molecular weight reduction due to hydrogenolysis of carbon—carbon single bonds. Generally, aromatics saturation is preferably performed at relatively low temperatures which favor the hydrogenation equilibrium while simultaneously minimizing undesirable molecular weight reduction reactions due to carbon—carbon bond scission.

Aromatics saturation catalysts suitable for this invention have been described by Minderhoud et. al. in U.S. Pat. No. 4,960,505, and Winquist et. al. in U.S. Pat. No. 5,391,291, the teachings of which are incorporated herein by reference.

The aromatics saturation catalysts typically used in the aromatics saturation (hydrogenation) zone of the present process comprise one or more Group VIII noble metal hydrogenation components supported on an amorphous support such as alumina, silica-alumina, silica, titania or zirconia, or mixtures thereof, or a crystalline support such as aluminosilicates, aluminophosphates, silicoaluminophosphates or borosilicates. Large pore zeolites such as Zeolite Y, Mordenite, Zeolite Beta, and the like are combinations thereof are preferred aluminosilicates. Catalysts which contain a crystalline support are generally formed with an amorphous binder such as alumina, silica, or silica-alumina, with preference being given to the use of alumina. In particular, the aromatics saturation catalysts are preferably based on or supported on certain modified Y-type zeolites having a unit cell size between 24.18 and 24.35 Å. The modified Y-type materials also typically have an $SiO_2/Al_2O_3$ molar ratio of at least about 25, preferably about 35:1 and more preferably, about 50:1.

The Group VIII noble metals suitable for use in the aromatics saturation catalyst comprise ruthenium, rhodium, palladium, osmium, iridium, platinum and mixtures thereof. Very good results have been obtained with combinations of platinum and palladium. The use of aromatics saturation catalysts containing both platinum and palladium is preferred since such catalysts allow relatively low hydrogenation temperatures. The Group VIII noble metals are suitably applied in amounts between about 0.05 percent by weight and about 3 percent by weight, basis the carrier or support material. Preferably, the amounts of noble metals used are in the range between about 0.2 percent by weight and about 2 percent by weight, basis the support material. When two noble metals are utilized, the amount of the two metals normally ranges between about 0.5 percent by weight and about 3 percent by weight, basis the support material. When platinum and palladium are used as the noble metals, normally a platinum/palladium molar ratio of 0.25–0.75 is typically utilized.

After the starting hydrocarbon feed has been subjected to a hydrotreating step and an aromatics saturation step, the hydrocarbon product from the aromatics saturation zone is then passed to a steam cracking (pyrolysis) zone. Prior to being sent to the steam cracking zone, however, if desired, the hydrocarbon product from the aromatics saturation zone may be passed to a fractionating zone for removal of product gases, and light hydrocarbon fractions.

In the steam cracking zone, the product from the aromatics saturation zone and steam are heated to cracking temperatures. The operating conditions of the steam cracking zone normally include a coil outlet temperature greater than about 700° C., in particular between about 700° C. and 925° C., and preferably between about 750° C. and about 900° C., with steam present at a steam to hydrocarbon weight ratio in the range of from about 0.1:1 to about 2.0:1. The coil outlet pressure in the steam cracking zone is typically in the range of from about 0 psig to about 75 psig, preferably in the range of from about 0 psig to about 50 psig. The residence time for the cracking reaction is typically in the range of from about 0.01 second to about 5 seconds and preferably in the range of from about 0.1 second to about 1 second.

After the starting hydrocarbon feed has been subjected to a hydrotreating step, an aromatics saturation step, and a steam cracking step, the effluent from the steam cracking step may be sent to one or more fractionating zones wherein the effluent is separated into a fraction comprising hydrogen and $C_1$–$C_4$ hydrocarbons, a steam cracked naphtha fraction boiling from $C_5$ to about 220° C., a steam cracked gas oil fraction boiling in the range of from about 220° C. to about 275° C. and a steam cracked tar fraction boiling above about 275° C. The amount of the undesirable steam cracked products, i.e., steam cracked gas oil and steam cracked tar, obtained utilizing the process of the present invention is quite low. The yield of steam cracked gas oil is reduced by at least about 30 percent, relative to that obtained when either untreated or hydrotreated feedstock is subjected to steam cracking and product separation, and the yield of steam cracked tar is reduced by at least about 40 percent, relative to that obtained when either untreated or hydrotreated feedstock is subjected to steam cracking and product separation.

The process according to the present invention may be carried out in any suitable equipment. The various hydrotreating and saturation zones in the present invention typically comprise one or more vertical reactors containing at least one catalyst bed and are equipped with a means of injecting a hydrogen source into the reactors. A fixed bed hydrotreating and aromatics saturation reactor system wherein the feedstock is passed over one or more stationary beds of catalyst in each zone is particularly preferred.

The ranges and limitations provided in the instant specification and claims are those which are believed to particularly point out and distinctly claim the instant invention. It is, however, understood that other ranges and limitations that perform substantially the same function in substantially the same manner to obtain the same or substantially the same result are intended to be within the scope of the instant invention as defined by the instant specification and claims.

DETAILED DESCRIPTION OF THE DRAWINGS

Figure 3:
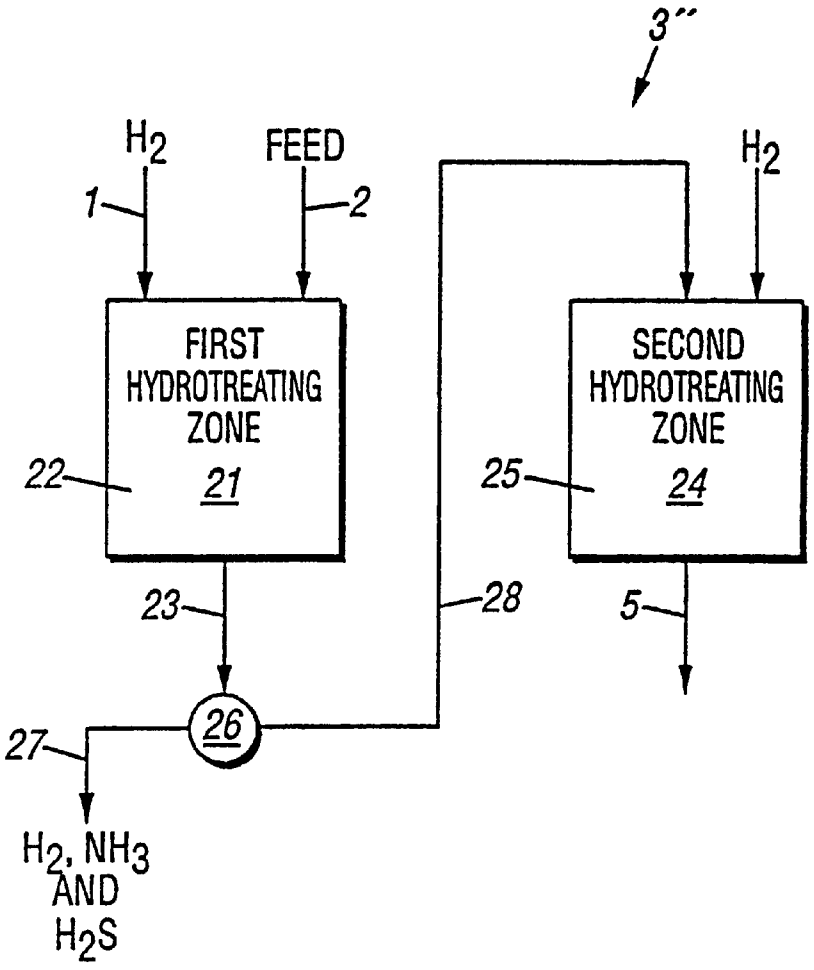
FIG. 3 illustrates a third embodiment of the hydrotreating zone shown in FIG. 1 wherein a hydrogen containing gas stream is admixed with the hydrocarbon feedstock and passed to two hydrotreating zones employing two different hydrotreating catalysts contained within two different reactors with an intervening product separation zone.
Figure 2:
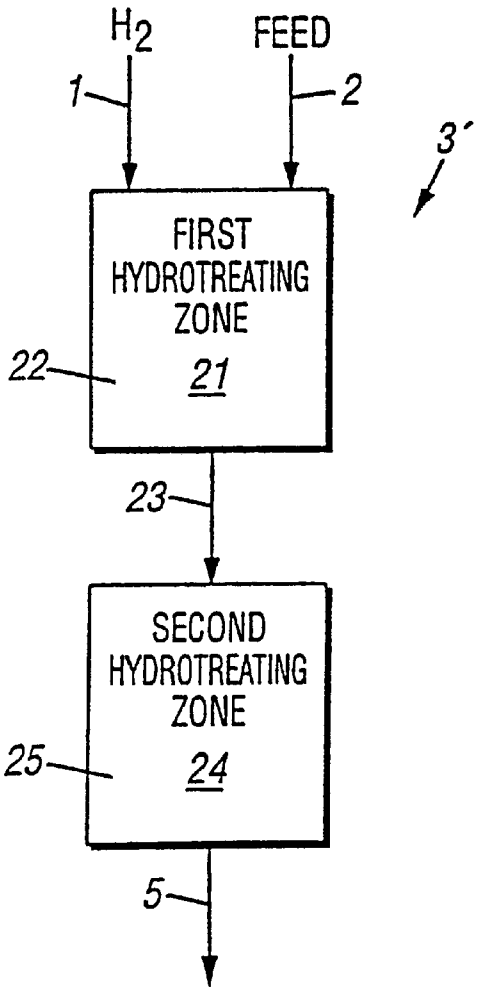
FIG. 2 illustrates a second embodiment of the hydrotreating zone shown in FIG. 1 wherein a hydrogen containing gas stream is admixed with the hydrocarbon feedstock and passed, in series flow, to two hydrotreating zones employing two different hydrotreating catalysts contained within two different reactors.

For a more detailed description of the invention, reference is made to the attached drawings, FIGS. 1, 2 and 3, which are simplified flow sheets illustrating particular embodiments of the invention.

In FIG. 1, hydrogen via line 1, hydrocarbon feedstock via line 2 and, optionally, recycled steam cracked naphtha via line 18 and/or steam cracked gas oil via line 19 are passed into hydrotreating zone 3. The hydrotreating catalyst 4 in the hydrotreating zone 3 typically comprises one or more Group VIB and/or Group VIII metal compounds supported on an amorphous carrier such as alumina, silica-alumina, silica, zirconia or titania. In one embodiment, hydrotreating zone 3 may also contain a second hydrotreating catalyst in addition to hydrotreating catalyst 4. In this embodiment, the second hydrotreating catalyst typically comprises one or more Group VIB and or Group VIII metal compounds supported on an acidic porous support. Preferably, the two hydrotreating catalysts are arranged in a stacked bed or layered configuration with hydrotreating catalyst 4 being on top and the second hydrotreating catalyst being on bottom.

Hydrotreating zone 3 is typically operated at temperatures in the range of from about 200° C. to about 550° C., preferably from about 250° C. to about 500° C. The pressure in the hydrotreating zone is generally in the range of from about 400 psig to about 3,000 psig, preferably from about 400 psig to about 1,500 psig. Liquid hourly space velocities (LHSV) will typically be in the range of from about 0.1 to about 10, preferably from about 0.5 to about 5 volumes of liquid hydrocarbon per hour per volume of catalyst, and hydrogen to oil ratios will be in the range of from about 500 to about 10,000 standard cubic feet of hydrogen per barrel of feed (SCF/BBL), preferably from about 1,000 to about 5,000 SCF/BBL, most preferably from about 2,000 to about 3,000 SCF/BBL. It is desirable in hydrotreating zone 3 to reduce the organic sulfur level to below about 100 parts per million, preferably below about 50 parts per million, and more preferably below about 25 parts per million, and the organic nitrogen level to below about 15 parts per million, preferably below about 5 parts per million, and more preferably below about 3 parts per million.

The total effluent from the hydrotreating zone 3 is withdrawn via line 5 and passed through a separator 6 where gaseous products i.e. hydrogen, ammonia and hydrogen sulfide are removed through line 7. Optionally, a light hydrocarbon fraction may also be removed before the liquid hydrocarbon stream is withdrawn from the separator 6 via line 8. The liquid hydrocarbon stream in line 8 and hydrogen via line 9 are then passed into aromatics saturation zone 10.

The aromatics saturation catalyst 11 typically used in the aromatics saturation zone 10 of the present process comprises one or more Group VIII noble metal hydrogenation components supported on an amorphous or crystalline support.

Aromatics saturation zone 10 is typically operated at temperatures between about 200° C. and about 370° C., preferably between about 250° C. and about 350° C., and most preferably between about 275° C. and about 350° C., and a pressure in the range of from about 400 psig to about 3,000 psig, preferably in the range of from about 400 psig to about 1,500 psig, more preferably in the range of from about 400 psig to about 1,000 psig, and most preferably in the range of from about 400 psig to about 600 psig. Liquid hourly space velocities in the aromatics saturation zone are typically in the range of from about 0.1 to about 10 volumes of liquid hydrocarbon per hour per volume of catalyst, preferably from about 0.5 to about 5, and more preferably from about 1 to about 3. Hydrogen/feedstock ratios between about 2,000 and about 15,000 SCF/BBL, preferably between about 3,000 and about 10,000 SCF/BBL, and most preferably between about 4,000 and about 8,000 SCF/BBL, can be suitably applied. Generally, a temperature will be chosen which allows substantial hydrogenation of the hydrogenatable components in the feedstock, i.e., at least about 70% of the total amount of components to be hydrogenated. It is preferable to carry out aromatics saturation under conditions which allow at least 80% conversion by hydrogenation of the hydrogenatable components, with greater than 90% conversion by hydrogenation being particularly preferred.

The total effluent from the aromatics saturation zone 10 is withdrawn via line 12. If desired, the product from aromatics saturation zone 10 may be passed to a separator where gaseous products i.e. hydrogen, ammonia and hydrogen sulfide, and a light hydrocarbon fraction can be removed. The product from the aromatics saturation zone in line 12 and steam via line 13 are then passed into steam cracking zone 14.

In steam cracking zone 14, the product from the aromatics saturation zone and steam are heated to cracking temperatures. The operating conditions of the steam cracking zone normally include a coil outlet temperature greater than about 700° C., in particular between about 700° C. and 925° C., and preferably between about 750° C. and about 900° C., with steam present at a steam to hydrocarbon weight ratio in the range of from about 0.1:1 to about 2.0:1. The coil outlet pressure in the steam cracking zone is typically in the range of from about 0 psig to about 75 psig, preferably in the range of from about 0 psig to about 50 psig. The residence time for the cracking reaction is typically in the range of from about 0.01 second to about 5 seconds and preferably in the range of from about 0.1 second to about 1 second.

The total effluent from the steam cracking zone 14 is withdrawn via line 15 and passed to fractionation zone 16 where a fraction comprising hydrogen and $C_1$–$C_4$ hydrocarbons are removed through line 17, steam cracked naphtha (boiling between $C_5$ and 220° C.) is removed through line 18, steam cracked gas oil boiling in the range of from about 220° C. to about 275° C. is removed through line 19 (the streams removed via line 18 and line 19 may optionally recycled to line 2 hydrocarbon feedstock to the hydrotreating zone 3), and steam cracked tar boiling above about 275° C. is removed through line 20.

In FIG. 2, the hydrotreating portion of the process (hydrotreating zone 3 in FIG. 1) is carried out using two hydrotreating zones, i.e., first hydrotreating zone 21 and second hydrotreating zone 24. The first hydrotreating catalyst 22 in first hydrotreating zone 21 will typically comprise one or more Group VIB and/or Group VIII metal compounds supported on an amorphous carrier such as alumina, silica-alumina, silica, zirconia or titania.

First hydrotreating zone 21 is generally operated at temperatures in the range of from about 200° C. to about 550° C., preferably from about 250° C. to about 500° C., and more preferably from about 275° C. to about 425° C. The pressure in the first hydrotreating zone is generally in the range of from about 400 psig to about 3,000 psig, preferably from about 400 psig to about 1,500 psig. Liquid hourly space velocities (LHSV) will typically be in the range of from about 0.2 to about 2, preferably from about 0.5 to about 1 volumes of liquid hydrocarbon per hour per volume of catalyst, and hydrogen to oil ratios will be in the range of from about 500 to about 10,000 standard cubic feet of hydrogen per barrel of feed (SCF/BBL), preferably from about 1,000 to about 5,000 SCF/BBL, most preferably from about 2,000 to about 3,000 SCF/BBL. These conditions are adjusted to achieve the desired degree of desulfurization and denitrification. Typically, it is desirable in the first hydrotreating zone to reduce the organic sulfur level to below about 500 parts per million, preferably below about 200 parts per million, and the organic nitrogen level to below about 50 parts per million, preferably below about 25 parts per million.

The total effluent from first hydrotreating zone 21 is passed via line 23 to second hydrotreating zone 24 and contacted with second hydrotreating catalyst 25. Second hydrotreating catalyst 25 typically comprises one or more Group VIB and/or a Group VIII metals compounds supported on an acidic porous support.

In second hydrotreating zone 24, the total effluent from first hydrotreating zone 21 is contacted with second hydrotreating catalyst 25 at temperature in the range of from about 200° C. to about 550° C., preferably from about 250° C. to about 500° C., and more preferably, from about 275° C. to about 425° C., a liquid hourly space velocity (LHSV) of about 0.1 to about 10 volumes of liquid hydrocarbon per hour per volume of catalyst, preferably about 0.5 to about 5, and a total pressure within the range of about 400 psig to about 3,000 psig, preferably from about 400 psig to about 1,500 psig. The hydrogen circulation rate is generally in the range of from about 500 to about 10,000 standard cubic feet per barrel (SCF/BBL), preferably from about 1,000 to 5,000 SCF/BBL, and most preferably from about 2,000 to 3,000 SCF/BBL. These conditions are adjusted to achieve substantially complete desulfurization and denitrification. Typically, it is desirable in the second hydrotreating zone to reduce the organic sulfur level to below about 100 parts per million, preferably below about 50 parts per million, and most preferably below about 25 parts per million, and the organic nitrogen level to below about 15 parts per million, preferably below about 5 parts per million and most preferably below about 3 parts per million.

The total effluent from the second hydrotreating zone 24 is withdrawn via line 5 and passed to separator 6 where gaseous products, i.e. hydrogen, ammonia and hydrogen sulfide are removed via line 7. optionally, a light hydrocarbon fraction may also be removed before the product from second hydrotreating zone 24 is passes via line 8 to the aromatics saturation zone 10.

In FIG. 3, the hydrotreating portion of the process (hydrotreating zone 3 in FIG. 1) is carried out using two hydrotreating zones, i.e., first hydrotreating zone 21 which contains first hydrotreating catalyst 22, and second hydrotreating zone 24 which contains second hydrotreating catalyst 25, as in FIG. 2, with a separator 26 between the two hydrotreating zones.

In this embodiment, the total effluent from the first hydrotreating zone 21 which contains the first hydrotreating catalyst 22 is withdrawn via line 23 and passed to separator 26 where gaseous products, i.e. hydrogen, ammonia and hydrogen sulfide are removed through line 27. Optionally, a light hydrocarbon fraction may be removed before the product from the first hydrotreating zone is withdrawn from the separator 26 via line 28. The liquid hydrocarbon stream in line 28 is then passed to the second hydrotreating zone 24 which contains the second hydrotreating catalyst 25.

The total effluent from the second hydrotreating zone 24 is then withdrawn via line 5 and passed to separator 6 where gaseous products i.e. hydrogen, ammonia and hydrogen sulfide are removed via line 7. Optionally, a light hydrocarbon fraction may also be removed before the product from second hydrotreating zone 24 is passed via line 8 to the aromatics saturation zone 10.

The invention will now be described by the following examples which are illustrative and are not intended to be construed as limiting the scope of the invention.

ILLUSTRATIVE EMBODIMENT 1

Example 1 and Comparative Example 1-A below were each carried out using a 100% Atmospheric Gas Oil (AGO) feedstock having the properties shown in Table 1 below. Example 1 illustrates the process of the present invention. Comparative Example 1-A illustrates AGO which has been subjected to hydrotreating only prior to steam cracking.

EXAMPLE 1

Example 1 describes the process of the present invention using a 100% Atmospheric Gas Oil (AGO) feed.

A commercial alumina supported nickel/molybdenum catalyst (1/20" trilobe), available under the name of C-411 from Criterion Catalyst Company, was used as the first hydrotreating catalyst (catalyst A) while a commercial prototype hydroprocessing catalyst (1/8" cylinder), available under the name of HC-10 from Linde AG was used as the second hydrotreating catalyst (catalyst B).

The catalysts A and B were operated in the hydrotreating zone as a "stacked bed" wherein the feedstock and hydrogen were contacted with catalyst A first and thereafter with catalyst B; the volume ratio of the catalysts (A:B) in the hydrotreating zone was 2:1. The feed stock was hydrotreated at 370° C. (700° F.), 600 psig total unit pressure, an overall LHSV of 0.33 $hr^{-1}$ and a hydrogen flow rate of 2,900 SCF/BBL.

Hydrotreating of the AGO feed consumed 550 SCF/BBL of hydrogen and resulted in the production of 2.0 percent by weight of light gases (methane, ethane, propane and butane) and 10.6 percent by weight of liquid hydrocarbon boiling between $C_5$ and 150° C. (300° F.).

After hydrotreating, the hydrocarbon product was distilled to remove the liquid hydrocarbon fraction boiling below 185° C. (365° F.).

The distilled hydrotreated feed was then passed to the aromatics saturation zone where it was contacted with hydrogen and a commercial zeolite supported platinum and palladium aromatics saturation catalyst (catalyst C), available under the name of Z-704C from Zeolyst International. The aromatics saturation zone was operated at 316° C. (600° F.), 600 psig total unit pressure, LHSV of 1.5 $hr^{-1}$ and a hydrogen flow rate of 5,000 SCF/BBL.

Aromatics saturation of the distilled hydrotreated AGO feed consumed 420 SCF/BBL hydrogen and resulted in the production of 0.4 percent by weight of light gases (methane, ethane, propane and butane) and 5.6 percent by weight of liquid hydrocarbon boiling between $C_5$ and 150° C. (300° F.).

After aromatics saturation, the hydrocarbon product was distilled to remove the liquid hydrocarbon fraction boiling below 185° C. (365° F.). Following aromatics saturation, the distilled saturated AGO had the properties shown in Table 1.

The distilled saturated AGO was then passed to the steam cracking zone where it was contacted with steam at a temperature of 775 to 780° C., a pressure of 10 to 15 psig, and a steam to hydrocarbon weight ratio of 0.30:1 to 0.45:1. The residence time in the steam cracker was 0.4 to 0.6 seconds. The steam cracked product was then sent to a fractionating zone to quantify total hydrogen ($H_2$) and $C_1$–$C_4$ hydrocarbons, steam cracked naphtha (SCN), steam cracked gas oil (SCGO), and steam cracked tar (SCT). The steam cracking results are presented in Table 3 below.

COMPARATIVE EXAMPLE 1-A

A 100% Atmospheric Gas Oil (AGO) feed was treated in the same manner as Example 1 above except that the AGO feed was not subjected to aromatics saturation prior to steam cracking. Following hydrotreating, the distilled hydrotreated AGO has the properties listed in Table 1 below. The steam cracking results are presented in Table 3 below.

TABLE 1

Properties of AGO Feed, Distilled Hydrotreated AGO (Comp. Ex. 1-A) and Distilled Saturated AGO (Ex. 1)

| | AGO Feed | Distilled Hydrotreated AGO (1-A) | Distilled Saturated AGO (Ex. 1) |
|---|---|---|---|
| wt. % C | 85.92 | 86.54 | 85.76 |
| wt. % H | 12.69 | 13.54 | 14.34 |
| wt. % S | 1.188 | <1 ppm | -nil- |
| ppm wt. N | 212 | <1 ppm | -nil- |
| Density, g/cm$^3$ @ 15° C. | 0.8773 | 0.8428 | 0.8213 |
| Simulated Distillation, D-2887 (ASTM), ° C. | | | |
| IBP | 216 | 173 | 181 |
| 5% | 258 | 212 | 200 |
| 10% | 274 | 231 | 211 |
| 30% | 306 | 286 | 261 |
| 50% | 325 | 312 | 298 |
| 70% | 343 | 333 | 323 |
| 90% | 369 | 363 | 355 |
| 95% | 384 | 379 | 369 |
| FBP | 434 | 429 | 416 |

The untreated AGO, the distilled hydrotreated AGO of Comparative Example 1-A, and the distilled saturated AGO of Example 1 were analyzed by GC-MS in order to determine the structural types of the hydrocarbons present. These results are shown in Table 2 below. As can be seen in Table 2 below, the process of the present invention (Example 1) is effective at reducing the aromatic content of hydrocarbon feed streams with a concomitant rise in the quantity of both paraffins/isoparaffins and naphthenes.

TABLE 2

Molecular Structural Types Observed in AGO Feed, Distilled Hydrotreated AGO (Comp. Ex. 1-A), and Distilled Saturated AGO (Ex. 1)

| Relative Abundance of Various Molecular Types, Vol. % | AGO Feed | Distilled Hydrotreated AGO (1-A) | Distilled Saturated AGO (Ex. 1) |
|---|---|---|---|
| Paraffins/Isoparaffins | 24.62 | 29.03 | 31.84 |
| Naphthenes | 41.64 | 45.76 | 64.13 |
| Aromatics | 33.73 | 25.22 | 4.03 |

TABLE 3

Laboratory Steam Cracking Yields for Gaseous Products, Naphtha, Gas Oil, and Tar

| Product Yield wt. % Based on Feedstock | Distilled Hydrotreated AGO (1-A) | Distilled Saturated AGO (Ex. 1) |
|---|---|---|
| Total $H_2$ and $C_1$–$C_4$ Hydrocarbons | 57.72 | 64.75 |
| Total Others $C_5$ and Greater | 42.28 | 35.25 |
| SCN, $C_5$–220° C. (430° F.) | 23.26 | 27.50 |
| SCGO, 220–275° C. (430–525° F.) | 7.13 | 3.22 |
| SCT, 275° C. (526° F.) and Above | 11.88 | 4.52 |
| Total | 100.00 | 100.00 |

TABLE 3-continued

Laboratory Steam Cracking Yields for Gaseous Products, Naphtha, Gas Oil, and Tar

| Product Yield wt. % Based on Feedstock | Distilled Hydrotreated AGO (1-A) | Distilled Saturated AGO (Ex. 1) |
|---|---|---|
| Selected Gaseous Products | | |
| Hydrogen | 0.52 | 0.55 |
| Methane | 9.18 | 10.33 |
| Ethane | 3.98 | 4.27 |
| Ethylene | 19.14 | 21.75 |
| Acetylene | 0.11 | 0.15 |
| Propane | 0.59 | 0.64 |
| Propylene | 13.91 | 15.12 |
| Propadiene & Methylacetylene | 0.25 | 0.32 |
| Butane & Isobutane | 0.14 | 0.16 |
| Isobutylene | 2.14 | 2.42 |
| Butene-1 | 2.30 | 2.67 |
| Butadiene-1,3 | 4.22 | 5.02 |
| Butene-2 (cis & trans) | 1.25 | 1.36 |
| $C_4$ acetylenes | 0.00 | 0.02 |
| Selected Liquid Products | | |
| Isoprene | 0.88 | 1.20 |
| Pentadiene (cis & trans) | 0.70 | 0.93 |
| Cyclopentadiene | 1.51 | 1.89 |
| Methylcyclopentadiene | 0.86 | 1.08 |
| Benzene | 4.26 | 6.17 |

As can be seen in Table 3 above, the yield of each of the particularly valuable steam cracked mono- and diolefin products in the $H_2$ and $C_1$–$C_4$ hydrocarbons fraction, i.e., ethylene, propylene, and butadiene, is increased by at least about 8 percent; the yield of each of the valuable steam cracked diolefin and aromatic products in the steam cracked naphtha fraction, i.e., isoprene, cis-pentadiene, trans-pentadiene, cyclopentadiene, methylcyclopentadiene, and benzene, is increased by at least about 25 percent; the yield of the low value steam cracked gas oil product is decreased by about 54 percent and the yield of the low value steam cracked tar product is decreased by about 62 percent when the process of the present invention comprising hydrotreating, aromatics saturation and steam cracking (Example 1) is utilized relative to the yields obtained when the feed is subjected to hydrotreating only prior to steam cracking (Comparative Example 1-A).

ILLUSTRATIVE EMBODIMENT 2

Example 2 and Comparative Example 2-A below were each carried out using a hydrotreated 100% Heavy Atmospheric Gas Oil (HT-HAGO) feedstock having the properties shown in Table 4 below, and Comparative Examples 2-B and 2-C were carried out using a 100% Heavy Atmospheric Gas Oil (HAGO) feedstock having the properties shown in Table 4 below. Example 2 illustrates the process of the present invention. Comparative Example 2-A illustrates HAGO which has been subjected to hydrotreating using a single hydrotreating catalyst, with no aromatics saturation, prior to steam cracking. Comparative Example 2-B illustrates untreated HAGO which has been steam cracked. Comparative Example 2-C illustrates HAGO which has been subjected to hydrotreating using a stacked bed of two hydrotreating catalysts with no aromatics saturation prior to steam cracking.

EXAMPLE 2

The following example describes the process using the C catalyst system described above to hydrogenate a hydrotreated 100% Heavy Atmospheric Gas Oil feedstock (HT-HAGO).

A commercial zeolite supported platinum and palladium catalyst, available under the name of Z-704C from Zeolyst International, was used as the aromatics saturation catalyst (catalyst C).

The already hydrotreated feed (HT-HAGO) and hydrogen were passed to the aromatics saturation zone and contacted with catalyst C. The aromatics saturation zone was operated at 300° C. (575° F.), 600 psig total unit pressure, an LHSV of 1.5 $hr^{-1}$ and a hydrogen flow rate of 5,000 SCF/BBL.

Aromatics saturation of the HT-HAGO feed consumed 520 SCF/BBL hydrogen and resulted in the production of 1.4 percent by weight of light gases (methane, ethane, propane and butane) and 13.3 percent by weight of liquid hydrocarbon boiling between $C_5$ and 150° C. (300° F.).

After aromatics saturation, the hydrocarbon product was distilled to remove the liquid hydrocarbon fraction boiling below 185° C. (365° F.). Following aromatics saturation, the distilled saturated HT-HAGO had the properties shown in Table 4.

The distilled saturated HT-HAGO was then passed to the steam cracking zone where it was contacted with steam at a temperature of 745 to 765° C., a pressure of 13 to 25.5 psig, and a steam to hydrocarbon weight ratio of 0.3:1 to 0.45:1. The residence time in the steam cracker was 0.4 to 0.6 seconds. The steam cracked product was then sent to a fractionating zone to quantify total hydrogen ($H_2$) and $C_1$–$C_4$ hydrocarbons, steam cracked naphtha (SCN), steam cracked gas oil (SCGO), and steam cracked tar (SCT). The steam cracking results are presented in Table 6 below.

COMPARATIVE EXAMPLE 2-A

The hydrotreated 100% Heavy Atmospheric Gas Oil (HT-HAGO) feed of Example 2 above was treated in the same manner as set forth in Example 2 above, except that the HT-HAGO was not subjected to aromatics saturation. The steam cracking results are presented in Table 6 below.

COMPARATIVE EXAMPLE 2-B

An untreated 100% Heavy Atmospheric Gas Oil (HAGO) feed was steam cracked using the procedure set forth in Example 2 above. The steam cracking results are presented in Table 6 below.

COMPARATIVE EXAMPLE 2-C

The untreated 100% Heavy Atmospheric Gas Oil (HAGO) feed of Comparative Example 2-B above was hydrotreated using two hydrotreating catalysts in a stacked bed system as follows.

A commercial alumina supported nickel/molybdenum catalyst, available under the name of KF-756 from Akzo Chemicals Inc., U.S.A., was used as the first hydrotreating catalyst (catalyst A) while a commercial zeolite nickel/tungsten catalyst, available under the name of Z-763 from Zeolyst International, was used as the second hydrotreating catalyst (catalyst B).

Catalysts A and B catalysts were operated as a "stacked bed" wherein the HAGO and hydrogen contacted catalyst A first and thereafter catalyst B, with the volume ratio of the catalysts (A:B) being 1:1. The HAGO was hydrotreated at 360° C. (675° F.), 585 psig total unit pressure, an overall LHSV of 0.5 $hr^{-1}$ and a hydrogen flow rate of 3,000 SCF/BBL.

The hydrotreated product was then steam cracked using the procedure set forth in Example 2 above. The steam cracking results are presented in Table 6 below.

TABLE 4

Properties of HAGO Feed (Comp. Ex. 2-B), HT-HACO (Comp. Ex. 2-A) Hydrotreated HAGO (Comp. Ex. 2-C) and Distilled Saturated HT-HAGO (Ex. 2)

| | HAGO Feed (2-B) | HT-HAGO (2-A) | Hydrotreated HAGO (2-C) | Distilled Saturated HT-HAGO (Ex. 2) |
|---|---|---|---|---|
| wt. % H | 12.76 | 13.31 | 13.47 | 14.15 |
| ppm wt. S | 12,400 | 8 | 41 | -nil- |
| ppm wt. N | 426 | <1 | 1 | -nil- |
| Density, G/cm$^3$ @ 15° C. | 0.8773 | 0.8383 | 0.8242 | 0.8285 |
| Simulated Distillation, D-2887 (ASTM), ° C. | | | | |
| IBP | 99 | 41 | 37 | 162 |
| 5% | 200 | 112 | 99 | 196 |
| 10% | 238 | 146 | 124 | 209 |
| 30% | 304 | 255 | 200 | 272 |
| 50% | 341 | 316 | 261 | 318 |
| 70% | 374 | 374 | 337 | 359 |
| 90% | 421 | 463 | 389 | 412 |
| 95% | 443 | 489 | 413 | 434 |

HT-HAGO (Comparative Example 2-A), HAGO feed (Comparative Example 2-B), hydrotreated HAGO (Comparative Example 2-C) and distilled saturated HT-HAGO (Example 2) were analyzed by GC-MS in order to determine the structural types of the hydrocarbons present. These results are shown in Table 5 below. The results clearly show that the process of the present invention (Example 2) is effective at reducing the aromatic content of hydrocarbon feed streams with a concomitant rise in the quantity of both paraffins/isoparaffins and naphthenes.

TABLE 5

Molecular Structural Types Observed in HAGO, HT-HAGO, Hydrotreated HAGO and Distilled Saturated HT-HAGO

| Relative Abundance of Various Molecular Types, Vol. % | HAGO (2-B) | HT-HAGO (2-A) | Hydrotreated HAGO (2-C) | Distilled Saturated HT-HAGO (Ex. 2) |
|---|---|---|---|---|
| Paraffins/Isoparaffins | 27.69 | 25.99 | 28.70 | 29.07 |
| Naphthenes | 38.87 | 46.16 | 41.29 | 67.25 |
| Aromatics | 33.46 | 27.84 | 30.00 | 3.67 |

TABLE 6

Laboratory Steam Cracking Yields for Gaseous Products, Naphtha, Gas Oil, and Tar

| Product Yield, wt. % Based on Feedutock | HAGO (2-B) | HT-HAGO (2-A) | Hydro-treated HAGO (2-C) | Distilled Saturated HT-HAGO (Ex. 2) |
|---|---|---|---|---|
| Total $H_2$ and $C_1$–$C_4$ Hydrocarbons | 48.73 | 59.75 | 52.66 | 64.76 |
| Total Others, $C_5$ and Greater | 51.27 | 40.25 | 47.34 | 35.24 |
| SCN, $C_5$–220° C. (430° F.) | 23.54 | 22.34 | 29.50 | 28.18 |
| SCGO, 220–275° C. (430–525° F.) | 4.83 | 5.80 | 6.06 | 2.69 |
| SCT, 275° C. (526° F.) and Above | 22.90 | 12.12 | 11.78 | 4.37 |
| Total | 100.0 | 100.00 | 100.0 | 100.0 |

TABLE 6-continued

Laboratory Steam Cracking Yields for Gaseous Products, Naphtha, Gas Oil, and Tar

| Product Yield, wt. % Based on Feedutock | HAGO (2-B) | HT-HAGO (2-A) | Hydro-treated HAGO (2-C) | Distilled Saturated HT-HAGO (Ex. 2) |
|---|---|---|---|---|
| Selected Gaseous Products | | | | |
| Hydrogen | 0.39 | 0.52 | 0.46 | 0.55 |
| Methane | 7.64 | 9.80 | 8.02 | 10.21 |
| Ethane | 4.03 | 4.24 | 3.91 | 4.44 |
| Ethylene | 14.39 | 20.08 | 16.54 | 21.25 |
| Acetylene | 0.06 | 0.15 | 0.07 | 0.16 |
| Propane | 0.72 | 0.64 | 0.62 | 0.66 |
| Propylene | 12.06 | 14.21 | 12.80 | 15.19 |
| Propadiene & Methylacetylene | 0.18 | 0.18 | 0.18 | 0.30 |
| Butane & Isobutane | 0.13 | 0.10 | 0.16 | 0.16 |
| Isobutylene | 1.88 | 1.98 | 2.16 | 2.3S |
| Butene-1 | 2.21 | 2.13 | 2.72 | 2.73 |
| Butadiene-1,3 | 3.32 | 4.54 | 3.74 | 5.36 |
| Butene-2 (cis & trans) | 1.25 | 1.11 | 1.27 | 1.38 |
| $C_4$ acetylenes | 0.01 | 0.07 | 0.01 | 0.03 |
| Selected Liquid Products | | | | |
| Isoprene | 0.89 | 0.83 | 1.08 | 1.29 |
| Pentadiene (cis & trans) | 0.74 | 0.47 | 0.95 | 1.01 |
| Cyclopentadiene | 1.19 | 1.40 | 1.48 | 2.14 |
| Methylcyclopentadiene | 0.81 | 0.74 | 1.06 | 1.20 |
| Benzene | 3.35 | 4.23 | 3.88 | 6.14 |

As can be seen in Table 6 above, the yield of each of the particularly valuable steam cracked mono- and diolefin products in the $H_2$ and $C_1$–$C_4$ hydrocarbons fraction, i.e., ethylene, propylene, and butadiene, is increased by at least about 18 percent, the yield of each of the valuable steam cracked diolefin and aromatic products in the steam cracked naphtha fraction, i.e., isoprene, cis-pentadiene, trans-pentadiene, cyclopentadiene, methylcyclopentadiene, and benzene, is increased by at least about 6 percent, the yield of the low value steam cracked gas oil product is decreased by about 55 percent, and the yield of the low value steam cracked tar product is decreased by about 62 percent when the process of the present invention comprising hydrotreating, aromatics saturation and steam cracking (Example 2) is utilized relative to the yields obtained when the feed is subjected to hydrotreating only prior to steam cracking (Comparative Example 2-C).

Similarly, as can be seen in Table 6 above, the yield of each of the particularly valuable steam cracked mono- and diolefin products in the $H_2$ and $C_1$–$C_4$ hydrocarbons fractions, i.e., ethylene, propylene, and butadiene, is increased at least about 5 percent, the yield of each of the valuable steam cracked diolefin and aromatic products in the steam cracked naphtha fraction, i.e., isoprene, cis-pentadiene, trans-pentadiene, cyclopentadiene, methylcyclopentadiene, and benzene, is increased by at least about 45 percent, the yield of the low value steam cracked gas oil product is decreased by about 53 percent and the yield of the low value steam cracked tar product is decreased by about 63 percent when the process of the present invention comprising hydrotreating, aromatics saturation and steam cracking (Example 2) is utilized relative to the yields obtained when the feed is subjected to hydrotreating only prior to steam cracking (Comparative Example 2-A).

It can also be seen in Table 6 above that the yield of each of the particularly valuable steam cracked mono- and diolefin products in the $H_2$ and $C_1$–$C_4$ hydrocarbons fraction, i.e., ethylene, propylene, and butadiene, is increased by at least about 26.0 percent, the yield of each of the valuable steam cracked diolefin and aromatic products in the steam cracked naphtha fraction, i.e., isoprene, cis-pentadiene, trans-pentadiene, cyclopentadiene, methylcyclopentadiene, and benzene, is increased by at least about 36 percent, the yield of the low value steam cracked gas oil product is decreased by about 44 percent and the yield of the low value steam cracked tar product is decreased by about 80 percent when the process of the present invention comprising hydrotreating, aromatics saturation and steam cracking (Example 2) is utilized relative to the yields obtained when the feed alone is subjected to steam cracking (Comparative Example 2-B).

ILLUSTRATIVE EMBODIMENT 3

Example 3, Comparative Example 3-B and Comparative Example 3-A below were each carried out using a 100% Catalytically Cracked Naphtha (CCN) feedstock having the properties shown in Table 7 below. Example 3 illustrates the process of the present invention. Comparative Example 3-A is illustrative of untreated CCN. Comparative Example 3-B illustrates CCN which has been subjected to hydrotreating only prior to steam cracking.

EXAMPLE 3

Example 3 describes the process of the present invention using a 100% Catalytically Cracked Naphtha (CCN) feed.

A commercial alumina supported nickel/molybdenum catalyst (1/20" trilobe), available under the name of C-411 from Criterion Catalyst Company, was used as the first hydrotreating catalyst (catalyst A) while a commercial prototype hydroprocessing catalyst (1/8" cylinder), available under the name of HC-10 from Linde AG was used as the second hydrotreating catalyst (catalyst B).

The catalysts A and B were operated in the hydrotreating zone as a "stacked bed" wherein the feedstock and hydrogen were contacted with catalyst A first and thereafter with catalyst B; the volume ratio of the catalysts (A:B) in the hydrotreating zone was 2:1. The feed stock was hydrotreated at 370° C. (700° F.), 600 psig total unit pressure, an overall LHSV of 0.33 $hr^{-1}$ and a hydrogen flow rate of 2,900 SCF/BBL.

Hydrotreating of the CCN feed consumed 860 SCF/BBL of hydrogen and resulted in the production of 0.9 percent by weight of light gases (methane, ethane, propane and butane) and 2.5 percent by weight of liquid hydrocarbon boiling between $C_5$ and 150° C. (300° F.).

The hydrotreated CCN was then passed to the aromatics saturation zone where it was contacted with hydrogen and a commercial zeolite supported platinum and palladium aromatics saturation catalyst (catalyst C), available under the name of Z-704C from Zeolyst International. The aromatics saturation zone was operated at 316° C. (600° F.), 600 psig total unit pressure, LHSV of 1.5 $hr^{-1}$ and a hydrogen flow rate of 5,000 SCF/BBL.

Aromatics saturation of the hydrotreated CCN feed consumed 1320 SCF/BBL hydrogen and resulted in the production of 1.9 percent by weight of light gases (methane, ethane, propane and butane) and 5.4 percent by weight of liquid hydrocarbon boiling between $C_5$ and 150° C. (300° F.). Following aromatics saturation, the saturated CCN had the properties shown in Table 7.

The saturated CCN was then passed to the steam cracking zone where it was contacted with steam at a temperature of 790 to 805° C., a pressure of between 18.0 to 20.5 psig, and a steam to hydrocarbon weight ratio of 0.3:1 to 0.45:1. The residence time in the steam cracker was 0.4 to 0.6 seconds. The steam cracked product was then sent to a fractionating zone to quantify total hydrogen ($H_2$) and $C_1$–$C_4$) hydrocarbons, steam cracked naphtha (SCN), steam cracked gas oil (SCGO), and steam cracked tar (SCT). The steam cracking results are presented in Table 9 below.

COMPARATIVE EXAMPLE 3-A

A 100% Catalytically Cracked Naphtha (CCN) feed was treated in the same manner as set forth in Example 3 above, except that it was not subjected to hydrotreating or to aromatics saturation. The steam cracking results are presented in Table 9 below.

COMPARATIVE EXAMPLE 3-B

A 100% Catalytically Cracked Naphtha (CCN) feed was treated in the same manner as set forth in Example 3 above, except that it was not subjected to aromatics saturation. The steam cracking results are presented in Table 9 below.

TABLE 7

Properties of CCN Feed (Comp. Ex. 3-A), Hydrotreated CCN (Comp. Ex. 3-B) and Saturated CCN (EX. 3)

| | CCN Feed (3-A) | Hydrotreated CCN (3-B) | Saturated CCN (Ex. 3) |
|---|---|---|---|
| wt. % C | 89.15 | 88.31 | 86.02 |
| wt. % H | 10.31 | 11.78 | 13.94 |
| ppm wt. S | 4,130 | 2 | -nil- |
| ppm wt. N | 217 | <1 | -nil- |
| Density, g/cm$^3$ @ 15° C. | 0.9071 | 0.8714 | 0.8208 |
| Simulated Distillation, D-2887 (ASTM), ° C. | | | |
| IBP | 189 | 75 | 72 |
| 5% | 202 | 161 | 134 |
| 10% | 205 | 183 | 158 |
| 30% | 212 | 204 | 186 |
| 50% | 221 | 212 | 198 |
| 70% | 230 | 223 | 208 |
| 90% | 236 | 235 | 226 |
| 95% | 242 | 244 | 233 |
| FBP | 376 | 341 | 280 |

CCN Feed (Comparative Example 3-A), the hydrotreated CCN (Comparative Example 3-B) and the saturated CCN (Example 3) were analyzed by GC-MS in order to determine the structural types of the hydrocarbons present. These results are shown in Table 8 below. As can be seen in Table 8, the process of the present invention (Example 3) is effective at reducing the aromatic content of hydrocarbon feed streams with a concomitant rise in the quantity of both paraffins/isoparaffins and naphthenes.

TABLE 8

Molecular Structural Types Observed in CCN Feed (Comp. Ex. 3-A), Hydrotreated CCN (Comp. Ex. 3-B) and Saturated CCN (Ex. 3)

| Relative Abundance of Various Molecular Types, Vol. % | CCN Feed (3-A) | Hydrotreated CCN (3-B) | Saturated CCN (Ex. 3) |
|---|---|---|---|
| Paraffins/Isoparaffins | 7.97 | 10.92 | 10.43 |
| Naphthenes | 5.19 | 26.79 | 88.39 |
| Aromatics | 86.83 | 62.27 | 1.18 |

TABLE 9

Laboratory Steam Cracking Yields for Gaseous Products Naphtha, Gas Oil, and Tar

| Product Yield wt. % Based on Feedstock | CCN Feed (3-A) | Hydrotreated CCN (3-B) | Saturated CCN (Ex. 3) |
|---|---|---|---|
| Total $H_2$ and $C_1$–$C_4$ Hydrocarbons | 27.67 | 33.32 | 54.05 |
| Total Others $C_5$ and Greater | 72.33 | 66.68 | 45.95 |
| SCN, $C_5$–220° C. (430° F.) | 40.85 | 35.79 | 34.96 |
| SCGO, 220–275° C. (430–525° F.) | 7.75 | 12.00 | 3.38 |
| SCT, 275° C. (526° F.) and Above | 23.73 | 18.89 | 7.61 |
| Total | 100.00 | 100.00 | 100.00 |
| Selected Gaseous Products | | | |
| Hydrogen | 0.65 | 0.74 | 0.79 |
| Methane | 8.03 | 9.58 | 12.9 |
| Ethane | 1.91 | 2.66 | 3.76 |
| Ethylene | 9.09 | 10.81 | 16.76 |
| Acetylene | 0.08 | 0.09 | 0.20 |
| Propane | 0.07 | 0.07 | 0.15 |
| Propylene | 4.79 | 5.81 | 10.77 |
| Propadiene & Methylacetylene | 0.08 | 0.08 | 0.21 |
| Butane & Isobutane | 0.03 | 0.02 | 0.05 |
| Isobutylene | 0.87 | 0.91 | 2.00 |
| Butene-1 | 0.25 | 0.27 | 1.02 |
| Butadiene-1,3 | 1.28 | 1.53 | 3.80 |
| Butene-2 (cis & trans) | 0.32 | 0.43 | 1.17 |
| $C_4$ acetylenes | 0.00 | 0.00 | 0.03 |
| Selected Liquid Products | | | |
| Isoprene | 0.00 | 0.35 | 0.91 |
| Pentadiene (cis & trans) | 0.13 | 0.15 | 0.48 |
| Cyclopentadiene | 0.49 | 0.80 | 1.75 |
| rnethylcyclopentadiene | 0.10 | 0.00 | 0.76 |
| Benzene | 2.79 | 4.03 | 9.10 |

As can be seen in Table 9 above, the yield of each of the particularly valuable steam cracked mono- and diolefin products in the $H_2$ and $C_1$–$C_4$ hydrocarbons fraction, i.e., ethylene, propylene, and butadiene, is increased by at least about 55.0 percent, the yield of each of the valuable steam cracked diolefin and aromatic products in the steam cracked naphtha fraction, i.e., isoprene, cis-pentadiene, trans-pentadiene, cyclopentadiene, methylcyclopentadiene, and benzene, is increased by at least about 118 percent, the yield of the low value steam cracked gas oil product is decreased by about 71 percent and the yield of the low value steam cracked tar product is decreased by about 59 percent when the process of the present invention comprising hydrotreating, aromatics saturation and steam cracking (Example 3) is utilized relative to the yields obtained when the feed is subjected to hydrotreating only prior to steam cracking (Comparative Example 3-B).

Similarly, it can be seen in Table 9 above that the yield of each of the particularly valuable steam cracked mono- and diolefin products in the $H_2$ and $C_1$–$C_4$ hydrocarbons fraction, i.e., ethylene, propylene, and butadiene, is increased by at least about 84 percent, the yield of each of the valuable steam cracked diolefin and aromatic products in the steam cracked naphtha fraction, i.e., isoprene, cis-pentadiene, trans-pentadiene, cyclopentadiene, methylcyclopentadiene, and benzene, is increased by at least about 226 percent, the yield of the low value steam cracked gas oil product is decreased by about 56 percent and the yield of the low value steam cracked tar product is decreased by about 67 percent when the process of the present invention comprising hydrotreating, aromatics saturation and steam cracking (Example 3) is utilized relative to the yields obtained when the feed alone is subjected to steam cracking (Comparative Example 3-A).

What is claimed is:

1. An integrated process for converting a hydrocarbon feedstock having components boiling above about 100° C. into steam cracked products, which process comprises:

a) passing said hydrocarbon feedstock in the presence of a hydrogen source and at least two hydrotreating catalysts in sequence through a hydrotreating zone at an elevated temperature and pressure to effect substantially complete decomposition of organic sulfur and/or nitrogen compounds contained therein, where a first hydrotreating catalyst comprises a component selected from the group consisting of Group VIB metals, Group VIB oxides, Group VIB sulfides, Group VIII metals, Group VIII oxides, Group VIII sulfides and mixtures thereof, supported on an amorphous carrier, and where a second hydrotreating catalyst comprises a Group VIB component selected from the group consisting of tungsten, molybdenum and mixtures thereof, a Group VIII component selected from the group consisting of nickel, cobalt and mixtures thereof, and an acidic carrier selected from the group consisting of amorphous silica-alumina and molecular sieves having a pore diameter greater than about six angstroms admixed with an inorganic oxide binder selected from the group consisting of alumina, silica, silica-alumina and mixtures thereof, b) passing the product from said hydrotreating zone to an aromatics saturation zone wherein said product is contacted at elevated pressure and a temperature in the range of from about 200° C. to about 370° C. with a hydrogen source and an aromatics saturation catalyst comprising one or more Group VIII noble metal hydrogenation components on a zeolitic support comprising a modified Y-type zeolite having a unit cell size between 24.18 and 24.35 Å and a $SiO_2/Al_2O_2$ molar ratio of at least 25, c) passing the product from said aromatics saturation zone to a steam cracking zone wherein said product is contacted with steam at temperatures greater than about 700° C., and d) recovering hydrogen and $C_1$–$C_4$ hydrocarbons, steam cracked naphtha, steam cracked gas oil and steam cracked tar therefrom, wherein the amount of steam cracked tar produced is reduced by at least about 40 percent, basis the starting hydrocarbon feedstock which has not been subjected to hydrotreating and aromatics saturation.

2. The process of claim 1 wherein said hydrocarbon feedstock has components boiling in the range of from about 150° C. to about 650° C.

3. The process of claim 1 wherein in step a), the sulfur level of the hydrocarbon feedstock is reduced to below about 100 parts per million and the nitrogen level of the hydrocarbon feedstock is reduced to below about 15 parts per million.

4. The process of claim 3 wherein in step a), the sulfur level of the hydrocarbon feedstock is reduced to below about 50 parts per million and the nitrogen level of the hydrocarbon feedstock is reduced to below about 5 parts per million.

5. The process of claim 4 wherein in step a), the sulfur level of the hydrocarbon feedstock is reduced to below about 25 parts per million and the nitrogen level of the hydrocarbon feedstock is reduced to below about 3 parts per million.

6. The process of claim 1 wherein said first hydrotreating catalyst and said second hydrotreating catalyst are arranged in said hydrotreating zone in a stacked bed configuration.

7. The process of claim 1 wherein said hydrotreating zone in step a) is operated at a temperature ranging from about 200° C. to about 550° C. and a pressure ranging from about 400 psig to about 3,000 psig.

8. the process of claim 1 wherein said catalyst in the aromatics saturation zone in step b) is supported on a zeolitic support comprising a modified Y-type zeolite having a unit cell size between 24.18 and 24.35 Å and a $SiO_2/Al_2O_2$ molar ratio of from about 35:1 to about 50:1.

9. The process of claim 1 wherein said Group VIII noble metal in said catalyst in the aromatic saturation zone in step b) is selected from the group consisting of palladium and mixtures of platinum and palladium.

10. The process of claim 1 wherein said aromatics saturation zone in step b) is operated at a temperature ranging from about 250° C. to about 350° C. and a pressure ranging from about 400 psig to about 3,000 psig.

11. The process of claim 1 wherein said aromatics saturation zone in step b) is operated at a temperature ranging from about 275° C. to about 350° C. and a pressure ranging from about 400 psig to about 1,500 psig.

12. The process of claim 1 wherein said steam cracking zone in step c) is operated at a temperature greater than about 700° C. and a coil outlet pressure ranging from about 0 psig to about 75 psig.

13. The process of claim 1 wherein said steam cracking zone in step c) is operated at a temperature ranging from about 700° C. to about 925° C. and a coil outlet pressure ranging from about 0 psig to about 50 psig.

14. The process of claim 1 wherein the yields of ethylene and propylene and butadiene in the $H_2$ and $C_1$–$C_4$ hydrocarbons fraction are each increased by at least about 2.5 percent, and the yields of isoprene, cis-pentadiene, trans-pentadiene, cyclopentadiene, methylcyclopentadiene and benzene in the steam cracked naphtha fraction are each increased by at least about 15 percent, basis the starting hydrocarbon feedstock which has not been subjected to hydrotreating and aromatics saturation.

15. An integrated process for converting a hydrocarbon feedstock having components boiling above about 100° C. into steam cracked products, which process comprises:

a) passing said hydrocarbon feedstock in the presence of a hydrogen source and a first hydrotreating catalyst through a first hydrotreating zone at an elevated temperature and pressure to reduce the levels of organic sulfur and/or nitrogen compounds contained therein, where the first hydrotreating catalyst comprises a component selected from the group consisting of Group VIB metals, Group VIB oxides, Group VIB sulfides, Group VIII metals, Group VIII oxides, Group VIII sulfides and mixtures thereof, supported on an amorphous carrier, b) passing the product from said first hydrotreating zone to a second hydrotreating zone wherein said product is contacted at elevated pressure and a temperature in the range of from about 200° C. to about 550° C. with a hydrogen source and a second hydrotreating catalyst comprising one or more hydrotreating components selected from the group consisting of Group VIB metals, Group VIB oxides and Group VIB sulfides, where the Group VIB metal is selected from the group consisting of tungsten, molybdenum and mixtures thereof, Group VIII metals, Group VIII oxides and Group VIII sulfides, where the Group VIII metal is selected from the group consisting of nickel, cobalt and mixtures thereof, and mixtures thereof, supported on an acidic carrier selected from molecular sieves having a pore diameter greater than about six angstroms admixed with an inorganic oxide binder selected from the group consisting of alumina, silica, silica-alumina and mixtures thereof, to effect substantially complete decomposition of organic sulfur and/or nitrogen compounds contained in the product from the first hydrotreating zone, c) passing the product from said second hydrotreating zone to an aromatics saturation zone wherein said product is contacted at elevated pressure and a temperature in the range of from about 200° C. to about 370° C. with a hydrogen source and an aromatics saturation catalyst comprising one or more Group VIII noble metal hydrogenation components on a zeolitic support comprising a modified Y-type zeolite having a unit cell size between 24.18 and 24.35 Å and a $SiO_2/Al_2O_2$ molar ratio of at least 25, d) passing the product from said aromatics saturation zone to a steam cracking zone wherein said product is contacted with steam at temperatures greater than about 700° C., and e) recovering hydrogen and $C_1$–$C_4$ hydrocarbons, steam cracked naphtha, steam cracked gas oil and steam cracked tar therefrom, wherein the amount of steam cracked gas oil produced is reduced by at least about 30 percent and the amount of steam cracked tar produced is reduced by at least about 40 percent, basis the starting hydrocarbon feedstock which has not been subjected to hydrotreating and aromatics saturation.

16. The process of claim 15 wherein said hydrocarbon feedstock has components boiling in the range of from about 150° C. to about 650° C.

17. The process of claim 15 wherein in step a), the sulfur level of the hydrocarbon feedstock is reduced to below about 500 parts per million and the nitrogen level of the hydrocarbon feedstock is reduced to below about 50 parts per million.

18. The process of claim 17 wherein in step a), the sulfur level of the hydrocarbon feedstock is reduced to below about 200 parts per million and the nitrogen level of the hydrocarbon feedstock is reduced to below about 25 parts per million.

19. The process of claim 15 wherein said first hydrotreating zone in step a) is operated at a temperature ranging from about 200° C. to about 550° C. and a pressure ranging from about 400 psig to about 3,000 psig.

20. The process of claim 15 wherein said second hydrotreating catalyst in step b) the Group VIII component is nickel, the Group VIB compound is selected from the group consisting of molybdenum, tungsten and mixtures thereof, the molecular sieve is zeolite Y having a unit cell size between 24.18 and 24.35 Å and the binder is alumina.

21. The process of claim 15 wherein in step b), the sulfur level of the hydrocarbon feedstock is reduced to below about 100 parts per million and the nitrogen level of the hydrocarbon feedstock is reduced to below about 15 parts per million.

22. The process of claim 21 wherein in step b), the sulfur level of the hydrocarbon feedstock is reduced to below about 50 parts per million and the nitrogen level of the hydrocarbon feedstock is reduced to below about 5 parts per million.

23. The process of claim 22 wherein in step b), the sulfur level of the hydrocarbon feedstock is reduced to below about 25 parts per million and the nitrogen level of the hydrocarbon feedstock is reduced to below about 3 parts per million.

24. The process of claim 15 wherein said second hydrotreating zone in step b) is operated at a temperature ranging from about 250° C. to about 500° C. and a pressure ranging from about 400 psig to about 3,000 psig.

25. The process of claim 15 wherein said catalyst in the aromatics saturation zone in step c) is supported on a zeolitic support comprising a modified Y-type zeolite having a unit cell size between 24.18 and 24.35 Å and a $SiO_2/Al_2O_2$ molar ratio of from about 35:1 to about 50:1.

26. The process of claim 15 wherein the Group VIII noble metal in said catalyst in the aromatic saturation zone in step c) is selected from the group consisting of palladium and mixtures of platinum and palladium.

27. The process of claim 18 wherein said aromatics saturation zone in step c) is operated at a temperature ranging from about 250° C. to about 350° C. and a pressure ranging from about 400 psig to about 3,000 psig.

28. The process of claim 15 wherein said aromatics saturation zone in step b) is operated at a temperature ranging from about 275° C. to about 350° C. and a pressure ranging from about 400 psig to about 1,500 psig.

29. The process of claim 15 wherein said steam cracking zone in step d) is operated at a temperature greater than about 700° C. and a coil outlet pressure ranging from about 0 psig to about 75 psig.

30. The process of claim 15 wherein said steam cracking zone in step d) is operated at a temperature ranging from about 700° C. to about 925° C. and a coil outlet pressure ranging from about 0 psig to about 50 psig.

31. The process of claim 15 wherein the yields of ethylene and propylene and butadiene in the $H_2$ and $C_1$–$C_4$ hydrocarbons fraction are each increased by at least about 2.5 percent, and the yields of isoprene, cis-pentadiene, trans-pentadiene, cyclopentadiene, methylcyclopentadiene and benzene in the steam cracked naphtha fraction are each increased by at least about 15 percent, basis the starting hydrocarbon feedstock which has not been subjected to hydrotreating and aromatics saturation.

* * * * *